US005749673A

United States Patent [19]

Kulp et al.

[11] Patent Number: 5,749,673

[45] **Date of Patent: *May 12, 1998**

[54] STACKABLE VERTICAL PANEL

[75] Inventors: Jack H. Kulp, San Juan Capistrano, Calif.; Billy E. Wehring, Austin, Tex.

[73] Assignee: Traffix Devices, San Clemente, Calif.

[ * ] Notice: The term of this patent shall not extend beyond the expiration date of Pat. No. 5,560,732.

[21] Appl. No.: 503,264

[22] Filed: Jul. 18, 1995

Related U.S. Application Data

[63] Continuation-in-part of Ser. No. 195,119, Feb. 10, 1994, Pat. No. 5,560,732.

[51] Int. Cl.[6] ..... E01F 9/012

[52] U.S. Cl. ..... 404/10; 40/612; 116/63 C

[58] Field of Search ..... 404/9, 10; 116/63 C, 116/63 P, 63 T; 40/606, 607, 612; 273/72 R, 67 R, 75, 73 J; 220/710.5; 229/402

[56] References Cited

U.S. PATENT DOCUMENTS

| | | | |
|---|---|---|---|
| D. 309,585 | 7/1990 | Kulp . | |
| 1,228,615 | 6/1917 | Stafford | 404/10 X |
| 1,939,968 | 12/1933 | Frei | 404/10 X |
| 2,103,410 | 12/1937 | Frei | 404/10 X |
| 2,378,750 | 6/1945 | Carew | 229/402 |
| 2,808,803 | 10/1957 | Weig | 40/612 X |
| 2,942,571 | 6/1960 | White | 40/612 X |
| 3,451,368 | 6/1969 | Keats . | |
| 3,591,144 | 7/1971 | Iving | 404/10 X |
| 3,732,842 | 5/1973 | Vara | 404/10 X |
| 4,102,454 | 7/1978 | Karevaara | 229/402 X |
| 4,197,808 | 4/1980 | Kinninger | 40/612 X |
| 4,412,644 | 11/1983 | La Fever | 229/402 |
| 4,511,281 | 4/1985 | Schmanski | 404/10 |
| 4,798,017 | 1/1989 | Giotis | 40/612 |
| 4,925,334 | 5/1990 | Beard | 116/63 C X |
| 4,973,190 | 11/1990 | Erwin | 404/10 |
| 5,024,435 | 6/1991 | Robbins | 273/72 R X |
| 5,026,204 | 6/1991 | Kulp et al. . | |
| 5,036,791 | 8/1991 | Thurston . | |
| 5,054,955 | 10/1991 | Habernig | 404/10 |
| 5,195,453 | 3/1993 | McGibbon, II | 116/63 P X |
| 5,234,280 | 8/1993 | Cowan | 404/6 |
| 5,287,822 | 2/1994 | Anderson | 116/63 P |
| 5,481,835 | 1/1996 | Bloom | 404/10 X |
| 5,482,270 | 1/1996 | Smith | 273/72 R |
| 5,560,732 | 10/1996 | Kulp et al. | 404/10 |

FOREIGN PATENT DOCUMENTS

| | | | |
|---|---|---|---|
| 233441 | 5/1964 | Austria | 116/63 P |
| 2633954 | 1/1990 | France | 404/10 |
| 2122239 | 1/1984 | United Kingdom . | |
| 2134577 | 8/1984 | United Kingdom | 40/612 |
| 2182701 | 5/1987 | United Kingdom | 116/63 C |
| 2213854 | 8/1989 | United Kingdom | 116/63 C |
| 2270332 | 3/1994 | United Kingdom | 404/9 |
| 2271594 | 4/1994 | United Kingdom | 404/9 |

OTHER PUBLICATIONS

ATSSA, MSI advertisement in Exhibitors Refernce Book, Mar. 18–20, 1990.

"Rubberized Plastic Signs Along Colorado Highways Outlast Steel 10 to 1", Popular Mechanics, Date Unknown.

*Primary Examiner*—James Lisehora

*Attorney, Agent, or Firm*—Donald E. Stout

[57] ABSTRACT

A safety delineator is provided which includes a conical body portion to which is attached one or more vertical panels. A new and improved handle feature permits easy and comfortable full hand gripping of the delineator and also prevents sticking and jamming together of a plurality of the delineators when they are stacked. The delineators may be stacked without removing the vertical panels, since each vertical panel is particularly designed to wrap around the conical body portion to which it is attached as another vertical delineator slides over it.

20 Claims, 2 Drawing Sheets

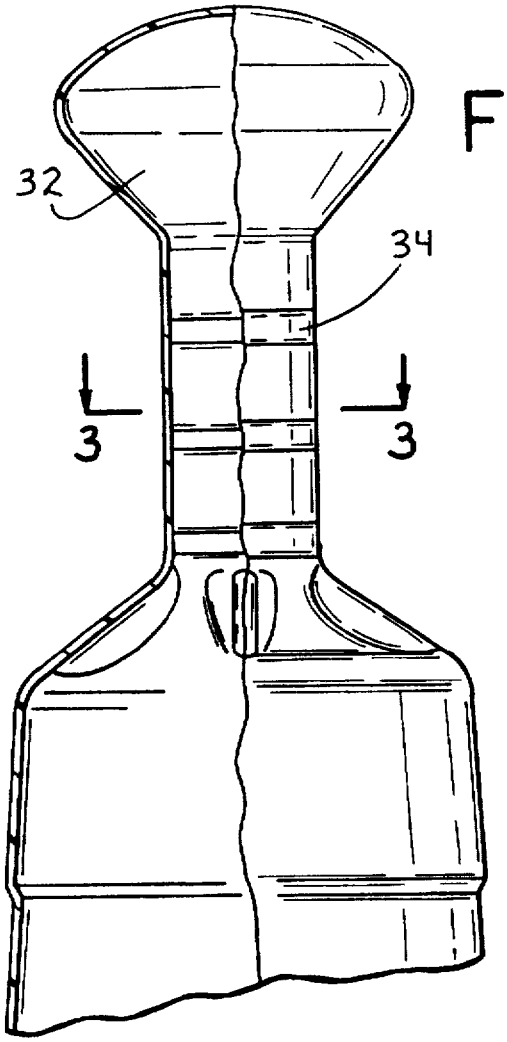
FIG. 2
FIG. 4
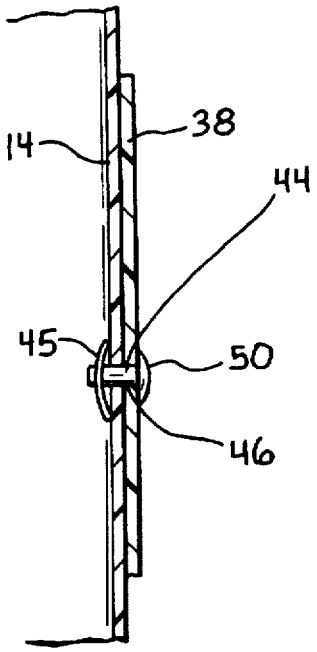
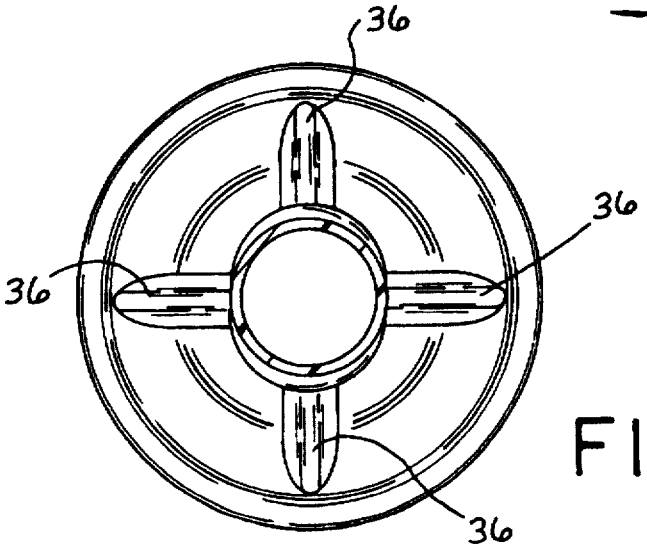
FIG. 3

STACKABLE VERTICAL PANEL

BACKGROUND OF THE INVENTION

This application is a continuation-in-part of application Ser. No. 08/195,119 entitled Safety Delineators, now U.S. Pat. No. 5,560,732 and filed on Feb. 10, 1994.

This application relates to traffic safety delineators, and more particularly to an improved vertical panel which is fixedly mounted to a traffic safety delineator having a conical structure, thereby having a unique capability of being easily stacked and transported.

Traffic safety delineators are extensively used at the present time to mark potential driving hazards, such as construction zones, potholes, etc., as well as to channelize traffic past such hazards. They are often used, as well, on sidewalks, bicycle paths, parking lots, indoor shopping malls, and the like to alert passersby to potential dangers, whatever the mode of transportation.

Vertical panels are well known in the prior art for use as barrel delineators when lack of space is an issue, being typically mounted on metallic stands and the like. They are most usually fabricated of polyethylene sheeting and have a minimum frontal surface area of 270 square inches as required by U.S. government standards, the frontal surface comprising alternating contrasting stripes (typically orange and white contrasting stripes) arranged in a diagonal pattern. This configuration has been shown to assist motorists in guiding their vehicles through the demarcated zone.

Traffic safety delineators having a conical structure are particularly widely used, and are commonly referred to as traffic safety cones. Although they may comprise only a freestanding conical body portion, they more typically include an integral weighted base as well, in order that the body portion may be stably supported in the wind gusts which are typically generated by high speed traffic, as well as by natural weather patterns. Prior art bases are typically fabricated of a solid material, such as rubber or plastic, in order to provide adequate weight to anchor the delineator body, which is typically molded of a resilient plastic.

Both traffic safety cones and vertical panels are designed to be temporary and portable, so are frequently lifted and transported from place to place, either within a single which permits a comfortable full hand grip of the cone.

SUMMARY OF THE INVENTION

The present invention solves the aforementioned problems of the prior art by providing a safety delineator having a conical body portion to which is attached one or more vertical panels. A new and improved handle feature permits easy and comfortable full hand gripping of the delineator and also prevents sticking and jamming together of a plurality of the delineators when they are stacked. The delineators may be stacked with the vertical panels attached thereto, since each vertical panel is particularly designed to wrap around the conical body portion to which it is attached as another vertical delineator slides over it.

More particularly, a safety delineator is provided which comprises a body portion having a top end and a base end, wherein the base end includes a horizontal support element for supporting the body portion in an upstanding position. A handle, which is adapted to permit convenient generally full hand gripping of the safety delineator, is integrally molded with the body portion and comprises a shaft portion axially oriented and extending axially upwardly from the body portion top end. A knob portion extends axially upwardly from the shaft portion. Preferably the handle is at least three inches long and the shaft portion has a sufficient length to permit all of the fingers of an average adult hand to be wrapped thereabout. One or more vertical panels are preferably fixedly attached to the body portion.

In another aspect of the invention, a safety delineator is provided which comprises a conical body portion constructed of a resilient plastic material and having a top end and a base end. The base end includes a horizontal support element for supporting the body portion in an upstanding position and one or more vertical panels fixedly attached to the body portion. Each vertical panel is preferably attached to its corresponding conical body using one or more mechanical fasteners, such as metal tubular rivets (plastic push rivets could be used as well), and is generally rectangular in shape, having two upper corners and two lower corners. The two upper corners of the vertical panel preferably have a rounded configuration to facilitate wrapping of the vertical panel about the circumference of the body portion to which it is attached when another delineator is stacked thereatop in a nesting fashion construction site as the construction project progresses, or between different sites. Thus, it is important that the temporary markers be easy and convenient to pick up. Unfortunately, however, neither prior art cones nor vertical panels typically provide means for being conveniently gripped, and are usually just lifted by attempting to grab some portion of the body portion of the cone or vertical panel itself. Both the cone and the vertical panel can be quite heavy and awkward to pick up, particularly with the supporting structure attached.

Several prior art designs have been developed to attempt to provide a handle for picking up traffic safety cones and the like. For example, a traffic safety cone having a bail handle, like that of a pail, extending from the top thereof is known in the prior art. Also, traffic safety cones and tubes are presently available which have a T-top handle extending from the top thereof Such a handle may be used to carry the tube or cone by grasping the T-top with one's fingers. However, neither type of handle is fully satisfactory in providing a convenient means for easily grasping and picking up a delineator, since they do not permit a comfortable, full hand grip, and tend to pinch and cramp the user's fingers over time.

Another problem with traffic safety cones results from the common practice of stacking the cones when storing or transporting them. Obviously, stacking the cones is advantageous because of the space which is saved and because of the increased number of cones which may be transported at one time. However, as one cone is dropped downwardly over another one in a stacking relationship, they tend to stick and jam together, because of the interfering contact between their respective sidewalls. This problem is aggravated in warm weather, when the cone sidewall material tends to expand and increase the interfering contact. Once jammed, they can be very difficult to separate, and the tedious process of doing so can be labor intensive and result in downtime and frustration for the construction crew.

Because of their non-uniform construction and typically metallic supporting stands, vertical panels are even more difficult to transport and store. Since they are not stackable, they tend to be stowed singly in a storage yard or truck in a somewhat haphazard manner, wasting space and increasing clutter.

What is needed, therefore, is a vertical panel having a supporting structure which permits convenient stacking of a plurality of vertical panels, as well as a handle for providing a convenient means for gripping the vertical panel, in order to transport it to a new location. Furthermore, an improved traffic safety cone is needed, including a contoured gripping means In yet another aspect of the invention, a method of storing or transporting a plurality of vertical panel delineators, wherein each delineator comprises a conical body portion having at least one vertical panel attached thereto, is disclosed. The method comprises the steps of standing a first one of said delineators in an upright position and stacking a second one of the delineators over the first delineator in a nesting fashion such that the vertical panel attached to the first delineators wraps about the conical body portion thereof as the second delineator slides over the first vertical panel.

The invention, together with additional features and advantages thereof, may best be understood by reference to the following description taken in conjunction with the accompanying illustrative drawing.

BRIEF DESCRIPTION OF THE DRAWING

FIG. 2 is a fragmentary view, partially in cross-section, of the top handle portion of the delineator illustrated in FIG. 1;

FIG. 3 is a cross-sectional view taken along lines 3—3 of FIG. 2;

FIG. 4 is a cross-sectional view taken along lines 4—4 of FIG. 1, illustrating a preferred means for attaching the vertical panels to the conical safety delineator.

DESCRIPTION OF THE PREFERRED EMBODIMENT

Figure 1:
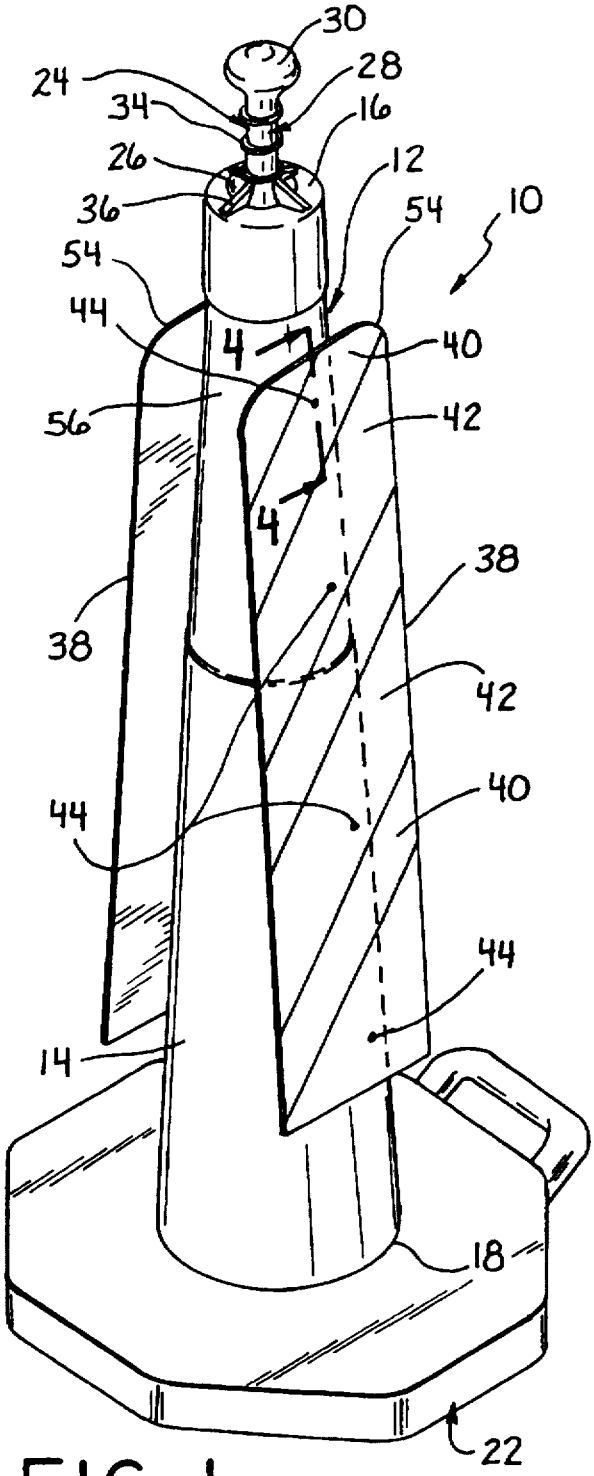
FIG. 1 is a perspective view illustrating a conical safety delineator (traffic safety cone) having vertical panels attached thereto, constructed in accordance with the present invention.

Referring now to the drawing, FIG. 1 illustrates a vertical panel delineator 10 constructed in accordance with the invention. The delineator 10 comprises a highway safety cone 12 having a conical body portion 14, which includes a top end 16 and a base end 18. The conical body portion 14 has a minimum diameter at the top end 16 and expands conically to a maximum diameter at the bottom end 18. At the bottom end, a lip portion 20 (FIG. 5) flares outwardly to form a horizontal support base for the cone body 14, and to provide a means for assembling the cone 12 to a weighted support base (gravity anchor) 22. The illustrated support base 22 is constructed of a solid dense material, preferably rubber, but could also comprise a hollow plastic ballasted member, as is discussed in the co-pending parent application 08/195,119 entitled Safety Delineators, now U.S. Pat. No. 5,560,732 and filed on Feb. 10, 1994. Both such bases are available commercially from the assignee of the present application. The cone body 14 itself, between the top end 16 and the lip portion 20, is conventional in construction and is preferably fabricated of a resilient plastic using known molding techniques.

An advantageous and important feature of the invention is the addition of a handle 24 to the cone 12, which enables a user to quickly and easily grip the cone in order to transport it between locations. The handle 24 is preferably molded to be integral with the cone body 14, extending upwardly from the top end 16, and is configured to generally resemble a doorknob. In its preferred configuration, the handle includes a first transition fillet 26, a necked down generally cylindrical shaft portion 28, and a generally hemispherical knob portion 30. The first fillet 26 transitions the handle 24 between the diameter of the top end 16 (approximately 4 inches in the preferred embodiment) and that of the cylindrical shaft 28. The diameter of the shaft 28 is small enough to be comfortably gripped by the hand of an average adult (approximately 1¼ inches in the preferred embodiment). A second transition fillet 32 (FIG. 2) transitions the handle 24 between the diameter of the shaft 28 and the diameter of the knob 30, which in the preferred embodiment is about 2¾ inches. The purpose of the knob is primarily to prevent a user's hand from slipping off of the end of the shaft 28. Of course, the actual configuration and dimensions of the handle 24 may be varied in accordance with particular design and manufacturing considerations, as long as it functions to permit easy and convenient gripping of the cone.

Preferably, the handle shaft portion 28 includes a plurality of spaced circumferential ribs 34 (FIGS. 1 and 2), which primarily function to improve a user's grip on the shaft by preventing slipping of his or her hand thereon. In the preferred embodiment, they are blended out at the mold parting line for ease of fabrication (not shown). Any number of ribs may be employed, but they may also be eliminated if desired, or replaced by an alternate non-skid surface, such as rubberized tape or the like.

Still another desirable feature is the employment of a plurality of circumferentially spaced stiffeners 36, best seen in FIG. 3, of which there are preferably four, although a different number may be used. The stiffeners 36, which are molded protrusions, extend axially through the first transition fillet 26, functioning to reinforce it and to prevent it from buckling because of downward pressure on the handle 24, which is commonly applied in the ordinary course of utilizing the cone 12.

A key feature of the present invention is the use of the safety cone 12 as a convenient platform for supporting one or more vertical panels 38. The vertical panels 38 are conventional, in that they are rectangular in configuration, preferably fabricated of polyethylene sheeting or some other flexible, weather-resistant material, and preferably have a minimum frontal surface area of 270 square inches, in order to meet current governmental regulations. In a preferred embodiment, they are approximately 8 inches in width and 36 inches in length. The frontal surface of each panel 38 (only one of which is shown) has a plurality of alternating contrasting stripes 40 and 42, which are preferably orange and white, respectively. Each vertical panel 38 is preferably attached to the body portion 14 of the safety cone 12 using metal tubular rivets 44 (best seen in FIG. 4), in combination with low profile washers 45 (FIG. 4). Alternatively, plastic push rivets could be utilized. The tubular rivet is pushed through a corresponding hole 46 in the body portion 14, as well as through the vertical panel 38. Once fully through both pieces, the washer 45 secures the attachment, the head 50 of the rivet being flush with the vertical panel 38. In the preferred embodiment, four such tubular rivets 44 are employed to secure each vertical panel 38. Of course a different number of rivets could be employed if desired, or other known fastening means could be alternatively utilized.

The use of the safety cone 12 as a standardized supporting platform for the vertical panels 38 greatly increases the versatility and functionality of the vertical panels. The cone 12, when used in combination with the weighted support base 22, easily withstands gusts caused by high speed traffic and prevailing weather conditions to remain in position. Furthermore, because of the handle 24 on the cone 12, the vertical panels 38 are conveniently carried by a worker for placement in a desired location. The cones 12 are more durable and lighter than the supporting platforms typically used for vertical panels in the prior art, many of which are metallic, because of their resilient plastic construction. Finally, and perhaps most significantly, the use of standardized cones 12 as platforms for the vertical panels 38 enables the panels 38 to be much more easily transported and stored, because of their stacking ability.

Figure 5:
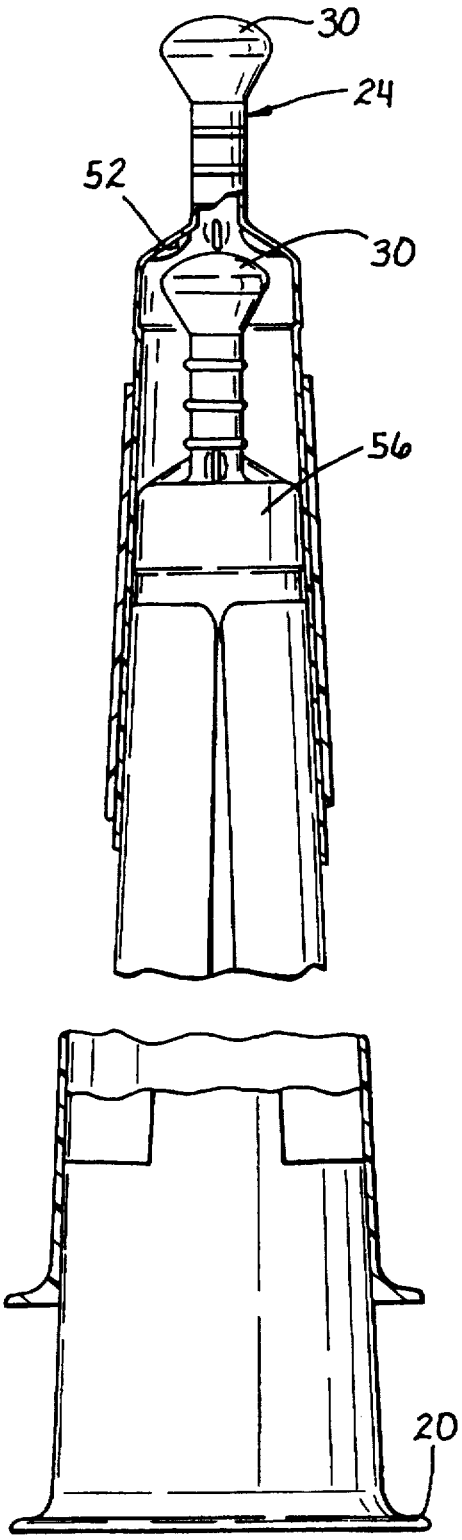
FIG. 5 is a cross-sectional view illustrating two stacked conical safety delineators of the type shown in FIG. 1.

As discussed above in the Background of the Invention portion of the specification, safety cones of the type herein disclosed, as well as many other types of traffic safety delineators and channelizers, are typically stacked for compact storage and for ease of transportability between locations. However, the prior art cones generally available in the prior art tend to stick and jam together when stacked, thereby making it difficult to separate them for use. This invention solves that problem because of the unique handle configuration at the top of each cone 12, which makes the cones self-spacing. Thus, when two or more cones are stacked together, as shown in FIG. 5, the top of the knob portion 30 of the lower cone abuts the interior surface 52 of the transition fillet 26 of the upper cone, thereby creating a stop which prevents further relative stacking motion between the two cones, i.e. further collapsing of the upper cone onto the lower one. Advantageously, the relative stacking motion is stopped by the abutment of the lower cone knob 30 on the upper cone interior surface 52 before the upper cone has descended onto the lower cone sufficiently to create a jamming or sticking problem.

As illustrated in the drawing, the cones 12 may be stacked with the vertical panels 38 attached thereto; i.e. the vertical panel delineators 10 may be stacked without removing the vertical panels. This is possible because the vertical panels 38 are made of a flexible material (preferably polyethylene sheeting), so that as the upper cone 12 descends onto the lower one during the stacking process, the vertical panel 38 on the lower cone merely rolls about the circumference of the lower cone, as illustrated, so that substantially all of the reverse side of the vertical panel contacts the circumferential surface of the cone. In other words, the vertical panel 38 wraps around the cone as the upper cone slides over it. In order to enhance this "rolling" or "wrapping" action, the two upper corners 54 and 56 of each vertical panel 38 are preferably rounded. The rounding of the corners 54 and 56 causes them to better engage the inner surface of the upper cone as it descends, so that they "plow in", thereby enhancing the desired "rolling" or "wrapping" action. Thus, even when the vertical panels are attached, the stacked delineators do not stick and are rotatable about one another.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A safety delineator, comprising:

a molded body portion having a top end and a base end, said base end including a horizontal support element for supporting said body portion in an upstanding position;

a handle adapted to permit convenient full hand gripping of said safety delineator, said handle being integrally molded with said body portion and comprising a shaft portion axially oriented and extending axially upwardly from said body portion top end and a knob portion extending axially upwardly from said shaft portion; and an interior volume defined by said body portion and said handle portion, said volume being continuous between an interior surface of said knob portion and the base end of said body portion;

wherein said handle is at least three inches long and said shaft portion has a sufficient length to permit all of the fingers of an average adult hand to be wrapped thereabout, thereby enabling gripping of said safety delineator without substantial contact of said knob portion by any of said fingers.

2. A safety delineator as recited in claim 1, wherein said body portion comprises a sidewall, said safety delineator further comprising a vertical panel which is fixedly attached by at least one mechanical fastener to said body portion sidewall.

3. A safety delineator as recited in claim 1, wherein said body portion comprises a sidewall, said safety delineator further comprising a plurality of vertical panels which are each fixedly attached by at least one mechanical fastener to said body portion sidewall.

4. A safety delineator as recited in claim 2, wherein said mechanical fastener comprises a metal tubular rivet.

5. A safety delineator as recited in claim 2, wherein said vertical panel is generally rectangular in shape, having two upper corners and two lower corners, and said two upper corners having a rounded configuration.

6. A safety delineator as recited in claim 1, wherein said handle is approximately 5½ inches long.

7. A safety delineator as recited in claim 1, wherein said body portion top end has a first diameter, said shaft portion has a second diameter which is smaller than said first diameter, and said knob portion has a third diameter which is greater than said second diameter.

8. A safety delineator as recited in claim 7, wherein said knob portion is generally hemispherical.

9. A safety delineator as recited in claim 7, and further comprising a first transition region between said body portion top end and said shaft portion and a second transition region between said knob portion and said shaft portion.

10. A safety delineator as recited in claim 9, wherein said first transition region comprises a first fillet which provides a generally smooth transition between said first and second diameters and said second transition region comprises a second fillet which provides a generally smooth transition between said second and third diameters.

11. A safety delineator as recited in claim 7, wherein said second diameter is about one and one quarter inches, to thereby permit easy and convenient gripping of said shaft portion.

12. A safety delineator as recited in claim 1, wherein said body portion is conical.

13. A safety delineator as recited in claim 1, wherein said shaft portion has a textured outer surface, in order to provide an improved gripping surface.

14. A safety delineator as recited in claim 1, wherein said shaft portion includes a plurality of spaced circumferential ribs.

15. A safety delineator as recited in claim 1, wherein said shaft portion diameter is substantially the same at both axial ends of the shaft portion.

16. A safety delineator as recited in claim 1, wherein said body portion is conical and said shaft portion has a length adequate to ensure that when a plurality of conical delineators are axially stacked, in a nesting fashion, the handle of each lower delineator functions to stop the travel of the next higher stacked delineator downwardly thereupon before interfering contact between the conical sidewalls of the stacked delineators causes said delineators to stick or jam.

17. A safety delineator as recited in claim 16, and further comprising a vertical panel which is fixedly attached to said body portion, the side edges of said vertical panel being adapted to wrap about the outer circumference of the conical body portion when another delineator is stacked on top thereof.

18. A safety delineator, comprising:

a body portion having a top end and a base end, said base end including a horizontal support element for supporting said body portion in an upstanding position, said top end having a first diameter;

a handle adapted to permit convenient generally full hand gripping of said safety delineator, said handle being integrally molded with said body portion and comprising a shaft portion axially oriented and extending axially upwardly from said body portion top end and a knob portion extending axially upwardly from said shaft portion, said shaft portion having a second diameter which is smaller than said first diameter and said knob portion having a third diameter which is greater than said second diameter;

a first transition region between said body portion top end and said shaft portion and a second transition region between said knob portion and said shaft portion; and a plurality of circumferentially spaced stiffeners extending axially through said first transition region;

wherein said handle is at least three inches long and said shaft portion has a sufficient length to permit all of the fingers of an average adult hand to be wrapped thereabout.

19. A safety delineator as recited in claim 18, wherein there are four circumferentially spaced stiffeners.

20. A method of storing or transporting a plurality of vertical panel delineators for use in identifying road construction zones, each of which comprises a conical body portion fabricated of molded plastic and having at least one rectangular generally planar vertical panel having a flexible highly reflective material fixedly attached thereto, a portion of said vertical panel extending tangentially along a portion of said conical body portion, the method comprising the steps of:

standing a first one of said delineators in an upright position; and stacking a second one of said delineators over said first delineator in a nesting fashion such that the vertical panel attached to the first delineator wraps about the conical body portion thereof as the second delineator slides over the first vertical panel.

* * * * *